United States Patent [19]

Messick

[11] 4,228,729

[45] Oct. 21, 1980

[54] BUILDING ROOF STRUCTURE

[76] Inventor: Paul W. Messick, 1320 E. 58th St., Tulsa, Okla. 74105

[21] Appl. No.: 916,843

[22] Filed: Jun. 19, 1978

[51] Int. Cl.[3] ..... F24F 13/00

[52] U.S. Cl. ..... 98/32; 98/43 A; 98/DIG. 6; 52/22; 52/199

[58] Field of Search ..... 98/43 R, 43 A, 43 B, 98/43 C, 42 R, DIG. 6, 32, 42 A, 33 R; 52/199, 22

[56] References Cited

U.S. PATENT DOCUMENTS

| | | | |
|---|---|---|---|
| 667,292 | 2/1901 | Brooks | 52/22 |
| 2,439,095 | 4/1948 | Mitchel | 48/42 |
| 2,477,152 | 7/1949 | Stevenson | 98/32 |
| 2,733,649 | 2/1956 | Barron | 98/DIG. 6 |
| 2,770,955 | 11/1956 | Lundstrum | 98/43 A |
| 3,027,090 | 3/1962 | Zerhan, Jr. | 98/DIG. 6 |
| 3,157,251 | 11/1964 | Rasch | 52/643 |
| 3,352,225 | 11/1967 | Ffiske | 98/43 A |
| 3,517,601 | 6/1970 | Courchesne | 98/33 R |
| 3,521,546 | 7/1970 | Day | 98/32 |
| 3,611,906 | 10/1971 | Lorenz | 98/33 R |

*Primary Examiner*—Henry C. Yuen
*Attorney, Agent, or Firm*—Head & Johnson

[57] ABSTRACT

A roof structure for a building having end walls and side walls, the structure providing reduced air conditioning loads for the building, the roof having spaced apart purlins, roof sheeting affixed to the top edge of the purlins, ceiling sheathing affixed to the bottom edge of the purlins providing plenum areas between adjacent purlins and between the roof and ceiling sheathing, vents at one end wall providing means for entrance of outside air into one end of the plenum areas, and fan means connected with the plenum areas to draw air through the plenum areas and discharge it exteriorly of the building, thereby cooling the plenum areas and reducing the effective heat load of the building ceiling.

4 Claims, 5 Drawing Figures

BUILDING ROOF STRUCTURE

SUMMARY OF THE INVENTION

With rising energy costs, building owners, as well as building manufacturers and constructors, are seeking ways to provide building designs which reduce the total annual energy consumption required to maintain buildings at a comfortable temperature level. In a large part of the United States the costs of providing air conditioning during the summer months exceeds the cost of heating during the winter months. The area of greatest heat penetration of a typical building is the roof.

The difference between the desired temperature inside a building (such as 78° or less) and the temperature entering the building (as 150° or more) resulting from ambient outside temperature plus solar heat gain is called the cooling load temperature differential, or CLTD. The present invention is directed towards reducing a building's CLTD.

Expressed another way, the present invention is directed towards means of effectively reducing the solar heat gain of a roof. While the concepts of the invention are applicable to buildings in general, the invention is particularly directed to metal buildings of the type frequently employed for offices, warehouses, factories, shopping centers, wholesale and retail outlets, and so forth. Most metal buildings are partially prefabricated and include metal structural members and in most instances, metal coverings for exterior walls and the building roof. Because they can be expeditiously and economically erected, and because of their long life and relative freedom of maintenance, metal buildings have become exceedingly popular in the United States, and their popularity grows each year. One problem, however, with metal buildings has been that of providing adequate insulation to make them economical to air condition in the summer.

The present invention provides a roof, particularly useful in metal buildings, in which plenum chambers are formed between adjacent roof purlins and between the roof and the sheathing placed on the bottom of the purlins. Means is provided for forced movement of air through these plenum chambers to prevent heat buildup. This air movement substantially reduces the temperature to which the building is exposed and thereby significantly reduces the CLTD.

Others have provided forced means for ventilating building attics, and it has long been known that by good attic ventilation, the heat load in a building having an attic, as do most homes, can be reduced. However, metal buildings are traditionally structured without attic space. This is one of the economical features of metal buildings, and the lack of an attic space has precluded the adaptation of the residential type attic ventilation to metal building construction. The answer has been that most metal building manufacturers or contractors have attempted to reduce the CLTD by providing substantially increased insulation thickness between the roof and ceiling. While the industry's standard roll-type insulation serves its highly useful purpose, it is expensive, and decreases in efficiency with additional thickness, if installed in the usual way between the purlins and the roof sheets of a typical metal building roof. The present invention overcomes the problems with the existing type of metal building construction by providing a roof structure having highly improved heat load characteristics.

This invention provides a roof system primarily for metal buildings consisting of a double roof design with rigid insulation, or sheathing which supports insulation, being installed below the roof joists (purlins) as the second roof, thus providing plenum chambers between adjacent purlins and between the roof sheathing and the insulation, with end wall vents to provide a means for entrance of outside air into the plenum chambers, and with fans, connected to the plenum chambers, to provide a means to draw outside air through the plenum chambers and discharge it exteriorly of the building, thereby cooling the plenum chambers and greatly reducing the solar heat gain before it enters the building's interior area.

DETAILED DESCRIPTION

Figure 1:
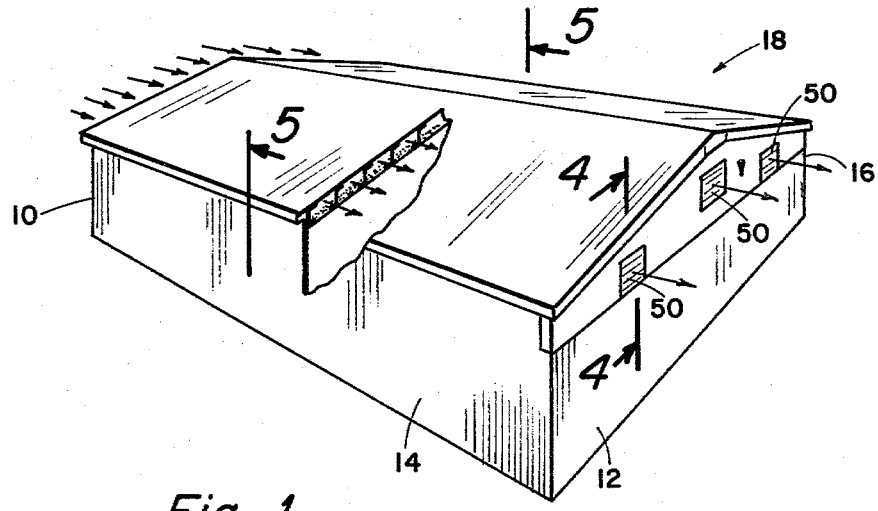
FIG. 1 is a perspective external view of a typical metal building, partially cut away, showing how the present invention is adapted to the roof structure for improved cooling load reduction by using end wall discharge fans.

Referring to the drawings and first to FIG. 1, an external view of a typical metal building is shown partially cut away and showing how the principles of this invention are adapted to the building design. The building includes a first end wall 10 and opposed second end wall 12, the first end wall 10 not being seen in FIG. 1, and side walls 14 and 16, the opposed side wall 16 not being seen. The building includes a typical gabled roof generally indicated by the numeral 18.

Figure 2:
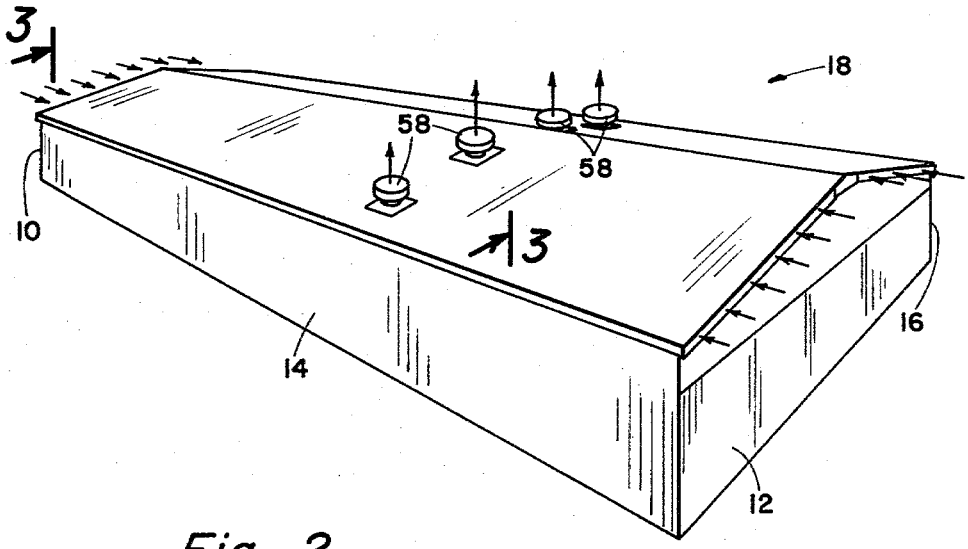
FIG. 2 is a perspective view, as in FIG. 1, but showing the arrangement wherein the fans utilized to move air through the roof plenum are located on the roof of the building.

FIG. 2 shows a building as in FIG. 1 but including a different fan arrangement for a positive movement of the air through the roof structure, particularly useful on longer buildings, as will be described in detail subsequently.

Figures 3, 4, 5:
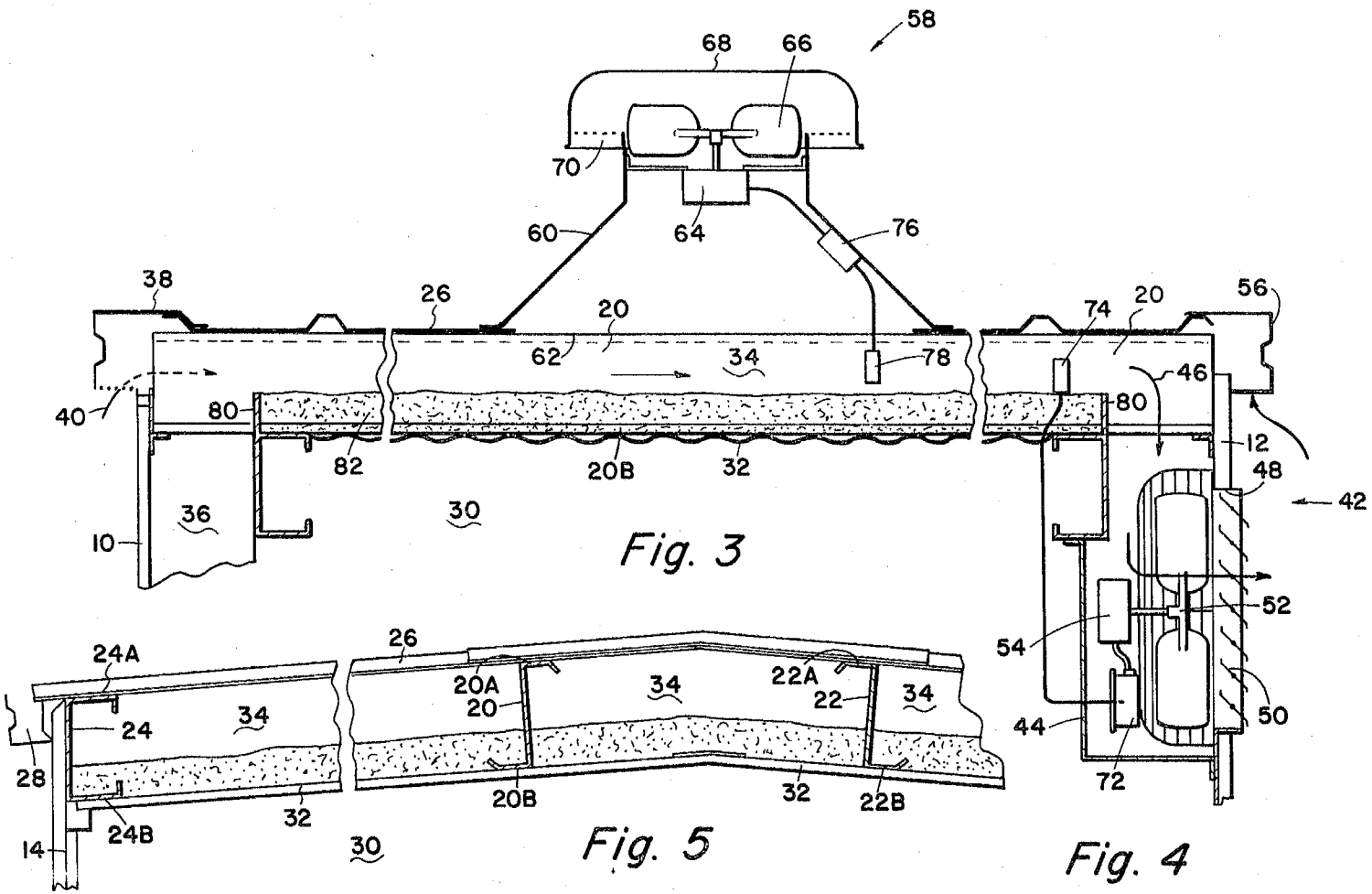
FIG. 3 is a partial cross-sectional view taken along the line 3—3 of FIG. 2.
FIG. 4 is a partial cross-sectional view taken along the line 4—4 of FIG. 1.
FIG. 5 is a partial cross-sectional view of the building roof taken along the line 5—5 of FIG. 1.

Referring to FIGS. 4 and 5, which are cross-sectional views of the metal building as shown in FIGS. 1 and 2, more details of the invention will be seen. Turning first to FIG. 5, the building side wall 14 is shown. Supported by structural members not indicated in FIG. 5 are spaced apart roof purlins 20, 22, and eave strut 24. Eave strut 24 is at the side of the roof structure immediately above the side wall 14 and is C-shaped while typical roof purlins 20, 22 are Z-shaped.

Each of the purlins 20, 22, and eave strut 24 include a top edge designated by the letter A and a lower edge designated by the letter B. Positioned on the purlin top edges is roof sheathing 26 which provides a leak-proof and a substantially air-tight roof structure. In metal building construction, the roof sheathing 26 is typically ribbed type metal attached to the purlin upper edges. The outer edge of the roof sheathing may include a gutter 28.

In order to prevent the penetration of solar heat, to which the roof sheathing is constantly exposed, building erectors typically spray or install insulation against the lower surface of the roof sheathing. While this is effective to a limited extent, nevertheless, the interior 30 of the building is still subjected to the penetration of heat as the roof 26 becomes exceedingly hot due to direct exposure with the sun. The temperature of the roof sheathing 26 may reach or exceed 157° after long exposure to direct sunlight. If it is intended to keep the interior 30 of the building at a maximum of 78°, this means a cooling load temperature differential (CLTD) of 79°.

By the present invention, this CLTD may be reduced by as much as 60 to 90%, depending upon outside temperature.

To the lower edges 20B, 22B, 24B of the purlins and eave strut 20, 22, and 24, a ceiling sheathing 32 is attached. This may be in the form of plywood, insulation board, metal sheathing, or the like. The ceiling sheathing 32 on the lower edges of the purlins combined with the roof sheathing 26 on the upper edges of the purlins means that a plenum 34 is provided between each adjacent pair of paralleled purlins.

Referring to FIGS. 3 and 4, which are taken at right angles to the view of FIG. 5 and parallel to the purlins, a method whereby the plenum areas 34 between each adjacent pair of purlins may be employed to reduce the CLTD of the building is illustrated. The first end wall 10 which is shown to include column 36, is provided with a rake trim 38 having a lower vent or bird screen 40. In this manner the rake trim 38 provides communication between the outside air and the plenum 34 formed between adjacent purlins. At the opposite end wall 12 of the building, as shown in FIG. 4, a fan unit generally indicated by the numeral 42 is provided. In the illustrated arrangement, the fan unit includes a fan housing 44 which is attached to the second end wall 12 and provides a fan inlet 46 communicating with the plenum 34 formed between adjacent purlins. End wall 12 has an opening 48 therein which forms the fan exhaust to the building exterior. The opening 48 includes a louver 50 which may be of the self-closing type, that is, when air is not moving through the louvers, it automatically closes.

Mounted within fan housing 44 is a fan 52 driven by motor 54.

When the fan motor 54 is energized, air is drawn in through the rake trim inlet 40 and passes through the plenums 34, down through the fan inlet 46 and out the fan exhaust opening 48. Thus, the fan 52 serves to move air constantly, when the fan is energized, through the plenums 34 to effectively maintain the air in the plenums at a temperature only slightly above the outside ambient air temperature.

The second end wall 12 includes a rake trim 56 which does not have an opening, that is, no air is permitted to enter into the plenums 34 at the second end of the building, thereby permitting air movement only through the full length of each of the plenums.

The fan arrangement of FIG. 4 is utilized when the length of the building is not great, that is, when the resistance of movement of air through the full length of plenum 34 can be easily handled by fan 52. This arrangement is shown in FIG. 1 in which a plurality of fans covered by louvers 50 are employed. When the building is longer so that the resistance to movement of air for the full length of the plenums would require excess capacity fans, the arrangement can be made as illustrated in FIGS. 2 and 3 in which the roof mounted fan, generally indicated by the numeral 58, is employed. Fan 58 includes a housing 60, which tapers outwardly and downwardly, the lower end of which is supported on the roof sheathing 26 and provides a fan outlet 62 having communication with a plurality of plenums 34. Fan 58 includes a motor 64 which drives blades 66. A canopy 68 covers the fan blade 66 and provides an annular fan exhaust opening 70. When the fan motor 64 is energized, air is drawn from both ends 10 and 12 of the building, as shown by the arrows in FIG. 2. When a roof mounted fan 58 is utilized, the rake trim at both ends of the building must be of the type shown in the left-hand portion of FIG. 3 identified by the numeral 38, that is, it must have a vent 40. By the central mounting of fans 58, air is drawn in both directions from the ends of the building through the plenums 34 and exhausted to reduce the CLTD of the building.

As shown in FIG. 4, a thermostatic control 72 will be placed in electrical series with motor 54. A remote probe 74 is positioned in a plenum 34. In this manner, fan 52 can be regulated by control 72 to be energized when the temperature in plenum 34 exceeds a preselected level, such as 85°. Fan 52 will thereby be energized to move the air through the plenums 34 until the temperature drops below the preset minimum level.

In like manner, as shown in FIG. 3, a control 76 is in electrical series with motor 64 of roof mounting fan 58, actuated by a remote probe 78 positioned in the plenum 34 to serve the same purpose.

Assuming the outside temperature on a sunny day is 99° ambient, the roof sheathing 26 of the building may, as previously indicated, approach a temperature of 157°. If it is required that the interior 30 of the building be maintained at a temperature not exceeding 78°, this means that there is a CLTD of 79°. Even if insulation is applied to the underneath surface of the roof sheathing 26, as is the current practice, a part of the CLTD depending upon inplace insulation rating, will enter the interior 30 of the building.

By the application of the principles of this invention, fans, whether the wall mounted fan 52 or the roof mounted fan 58, are employed which serve to move air through the plenums 34 maintaining the temperature to which the upper surface of the ceiling sheathing 32 is exposed to substantially that of the ambient air temperature. This temperature will normally be slightly above the ambient air temperature since there is a limit to the quantity of air which can be economically moved through the plenums, but for all practical purposes, the air will be only a few degrees above ambient, for instance, 103° under the stated conditions. Thus, the CLTD across the ceiling sheathing 32 is only the difference between 103° and 78°, that is, 25°, compared to a CLTD of 79°. This represents a 68% reduction in the CLTD by the application of the principles of this invention.

As the outside ambient temperature drops, the differential CLTD will also drop, but the efficiency of this invention will increase because the plenums are being cooled by outside air which is nearer the same temperature as the desired inside temperature.

Assuming a sunny, ambient 80° with a roof sheathing temperature of 133° and a desired interior 30 temperature of 78°, by application of the principles of this invention, the plenum air may be only 83°. Thus, the CLTD across the ceiling sheathing 32 is only the difference between 83° and 78°, that is, 5°, compared to a CLTD of 55°. This represents a 91% reduction in the CLTD by application of the principles of this invention. Stated another way, the building's insulation efficiency is 55:5 or 11:1 under this condition.

When evening comes, the CLTD across roof sheathing 26 will decrease, and when the temperature of the air in the plenum chambers drops below that preset for the control 72 and 76 as detected by probe 74 and 78 respectively, the fans will be de-energized.

It is understood that the roof design of this invention is not intended to completely eliminate the usefulness of insulation. Roof 26 may be insulated, if desired, and, more importantly, the ceiling sheathing 32 will be insulated, and for this purpose, angles 80 (FIGS. 3 and 4) may be installed above the ceiling sheathing 32 to serve to provide a boundary for insulation 82. This insulation may be of various types, including blown-in insulation, bats of spun glass, or plastic foam. Insulation 82 serves to insulate the building interior 30 and is particularly useful in winter conditions when heating rather than air conditioning is required.

Thus, it can be seen that the roof design set forth herein effectively and substantially reduces the CLTD to which the interior of the building is subjected. By the provision of short depth plenums 34 formed between adjacent purlins and between the ceiling sheathing and roof sheathing, relatively small amounts of air need be moved to achieve a substantial CLTD reduction.

While the invention has been described with a certain degree of particularity, it is manifest that many changes may be made in the details of construction and the arrangement of components without departing from the spirit and scope of the disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A roof structure for a building having first and second end walls and opposed side walls, the roof structure providing reduced ari conditioning load for the building, comprising;

spaced apart horizontal prulins supported at their ends by building exterior end walls, each purlin having a top edge and a bottom edge;

roof sheathing affixed to the top edges of said purlins;

ceiling sheathing affixed to the bottom edges of said purlins providing horizontal plenums between the roof and ceiling sheathing and between adjacent purlins, the horizontal plenums thereby extending the length and width of the building roof, the maximum height of the plenums being equal the height of the purlins;

means at the first end wall for providing ventilation into each of the plenums formed between said purlins;

a fan means includes;

a fan housing mounted on the second end wall having an intake communication with said plenums at the second end wall;

an exhaust opening in said fan housing; and a fan supported in the fan housing which, when energized, withdraws air from the fan housing and thereby from the plenums and discharges air out said end wall exhaust opening.

2. A roof structure according to claim 1 wherein said ceiling sheathing includes insulation.

3. A roof structure according to claim 2 wherein said ceiling sheathing is in the form of insulated sheets.

4. A roof structure according to claim 1 including;

thermostatically controlled switch means in electrical series with said fan means, the switch means having a temperature probe, the probe being positioned in one of the plenums, the switch means being actuated to energize said fan means when the temperature detected by said probe exceeds a preselected level.

* * * * *